US005986193A

United States Patent [19]

Garrison

[11] Patent Number: 5,986,193

[45] Date of Patent: Nov. 16, 1999

[54] HOLDER FOR A MUSICAL INSTRUMENT

[76] Inventor: Stanley L. Garrison, 1712 Ann St., Muncle, Ind. 47303

[21] Appl. No.: 08/547,682

[22] Filed: Oct. 19, 1995

[51] Int. Cl.[6] ..... G10D 3/00

[52] U.S. Cl. ..... 84/327; 248/598

[58] Field of Search ..... 84/327, 280, 387 A, 84/453; 248/598, 596

[56] References Cited

U.S. PATENT DOCUMENTS 1,342,202 6/1920 Cox ..... 84/327
1,612,148 12/1926 Oettinger ..... 84/327

*Primary Examiner*—Cassandra C. Spyrou

[57] ABSTRACT

A device for holding musical instruments such as guitars in an upright position when not being used by the player. The device maintains the stability of the instrument with a gentle clamping action caused by the downward force exerted by the weight of the instrument itself being transferred via a hinged fulcrum to the forward arcing movement of an active rear support against a stationary forward support thus retaining the upright stability of the instrument and maintaining a relatively low center of gravity of the combined instrument and holding device. This function is accomplished without any action on the part of the user other than merely placing the instrument in the device and retrieval of the instrument is accomplished by merely lifting the instrument from the device. Further, there are no points of contact between the instrument and the holding device that are of an abrasive nature which could damage the delicate finish of the instrument with repeated use.

4 Claims, 2 Drawing Sheets

HOLDER FOR A MUSICAL INSTRUMENT

BACKGROUND OF THE INVENTION

1. Field of the Invention

The present invention relates to an adjustable holder used for holding an elongate musical instrument such as a guitar in an upright position where the longitudinal axis of the instrument is in the vertical orientation. The device is used for holding the instrument when it is temporarily unused by a performer or it can be used for displaying instruments offered for sale in mercantile situations or as a holder of instruments on display by collectors. Visual aesthetics, safety, and convenience are the primary attributes considered for the utility of such a device. The musical instrument should be displayed in an attractive position with a minimum of visually distracting components of the holding device interfering with the visual lines of instrument. The appearance of the holding device itself would also constitute an attribute of the visually aesthetic character of the holding device's utility. Safety is embodied by the overall stability of the device while holding the instrument, the level of restraint that is employed by the holding device, and the nature of the contact between the instrument and the holding device that could cause abrasion to the finished surface of the instrument. Convenience would be a measure of the physical manipulations required to affect the functions of the holding device, transportability of the holding device, and storage requirements of the holding device when it is not being used.

2. Description of the Prior Art

Typically, such instruments when not in use for brief periods or when displayed in retail establishments are cradled in devices of a tripod-like multi-leg nature where the instrument is balanced between several points of contact and the downward force of gravity on the instrument dispersed to three points of contact where two laterally separated points carry most of the weight at the bottom of the instrument and a third point of contact located at a higher elevation on the instrument with the instrument oriented to lean slightly backward against this third point of contact with the holding device constitutes a passive retention of the instrument in relation to the holding device. A disturbance to this resting position of the instrument can affect an imbalance to the relatively high center of gravity and cause either the instrument to fall from its balance with the holding device or cause the entire holding device with instrument to fall. Popular improvements add some means of controlling lateral movement of the instrument by placing a bifurcated extension at the highest point of the holding device contacting the narrowest part of the instrument; further an elastic band may be added to this extension and manually positioned to control dislodging the instrument from its backward lean in the holding device. While these improvements serve to increase certain aspects of the safety of the devices it is arguable that overall stability may decrease due to the higher center of gravity of the device.

BRIEF DESCRIPTION OF THE INVENTION

The present invention is a device for providing active retentive force in holding an elongate musical instrument such as a guitar while it is temporarily unused or is being displayed for merchandising or viewing purposes. This retention is accomplished by the structure of the device in that to a horizontally flat base is attached via a laterally positioned hinge another moveable horizontal surface onto which a musical instrument is placed. The downward gravitational force of the weight of the instrument is converted via the action of the hinge to forward movement of the rearward vertical extensions attached to the moveable horizontal surface that oppose forward vertical extensions attached to the stationary base. This forward movement effects a holding action on the musical instrument placed in the holding device, thus limiting forward and rearward instability of the instrument. Lateral instability is controlled by side vertical extensions attached to the moveable surface and manually adjustable to locations at the sides of the instrument being held and slightly forward of the rearward vertical extensions. The side mounted vertical extensions and the forward mounted stationary vertical extensions are manually adjusted to fit the dimensions of the individual instruments being held. The forward movement of the combined rearward and side vertical extensions against the stationary forward vertical extensions is the active retentive force embodied by the device.

The moveable hinged horizontal surface with the attached rearward and side vertical extensions is held in a slightly rearward orientation by the use of a spring underneath the moveable horizontal surface and deflecting off the stationary horizontal base surface. All surfaces that come into contact with the musical instrument are of a soft padded material that minimizes abrasive action to the delicate finished surface of the musical instrument.

The device maintains a firm holding force on the musical instrument directly proportional to the weight of the instrument due to the fact that the forward force applied by the rearward vertical extensions is a result of the downward force supplied by the weight of the instrument itself, accomplishing this holding action with a relatively low center of gravity by keeping the contact with the instrument near the bottom of the instrument which, combined with the expanded area of the stationary horizontal base on which the assembly is setting, creates a very stable configuration that resists all but the most severe traumas that would upset the upright position of the musical instrument being held by the device.

After the initial positioning of the adjustable stationary forward vertical extensions and the adjustable side vertical extensions to fit the instrument being held, the device requires only the placement of the musical instrument in the device to activate the holding force and retrieval of the instrument is accomplished by merely lifting the instrument from the device.

Relatively unobtrusive components of the device come into contact with the musical instrument thus minimizing obstruction to the visual form of the musical instrument.

DETAILED DESCRIPTION OF THE PREFERRED EMBODIMENT

Figure 1:
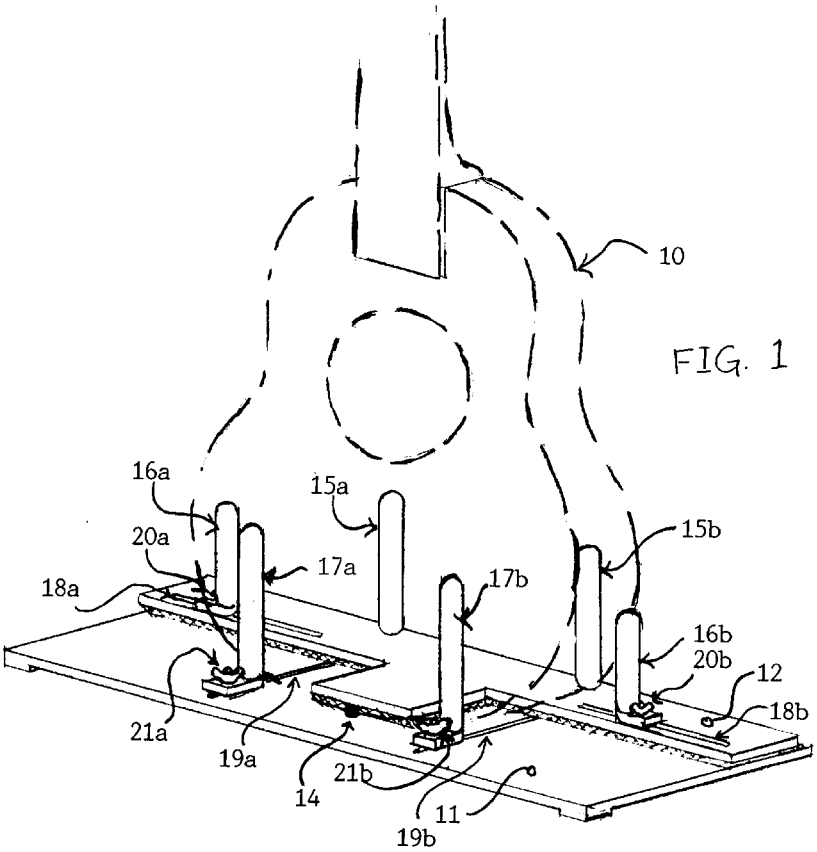
FIG. 1 is an axiomatic drawing of the holding device with a representative musical instrument represented by phantom lines.

Referring now to the drawings, there is shown in FIG. 1 a musical instrument such as a guitar 10 being retained by the holding device of present invention maintaining a vertical orientation of the longitudinally elongate dimension of the instrument placed therein. Upon the stationary base 11 is attached the hinged moveable horizontal surface 12 to which are attached the rearward vertical extensions 15*a* & 15*b* and the side vertical extensions 16*a* & 16*b,* these being manually moved into positions of contact with the sides of the musical instrument 10 by sliding in slots 18*a* & 18*b* and then tightening the wing-nut/screws 20*a* & 20*b*. The spring 14 has been compressed by the weight of the musical instrument 10 and has allowed the front of the musical instrument 10 to press against the forward vertical extensions 17*a* & 17*b* which have been manually moved into the proper positions by sliding in slots 19*a* & 19*b* and held there by tightening wing-nut/screws 21*a* & 21*b*.

Figure 2:
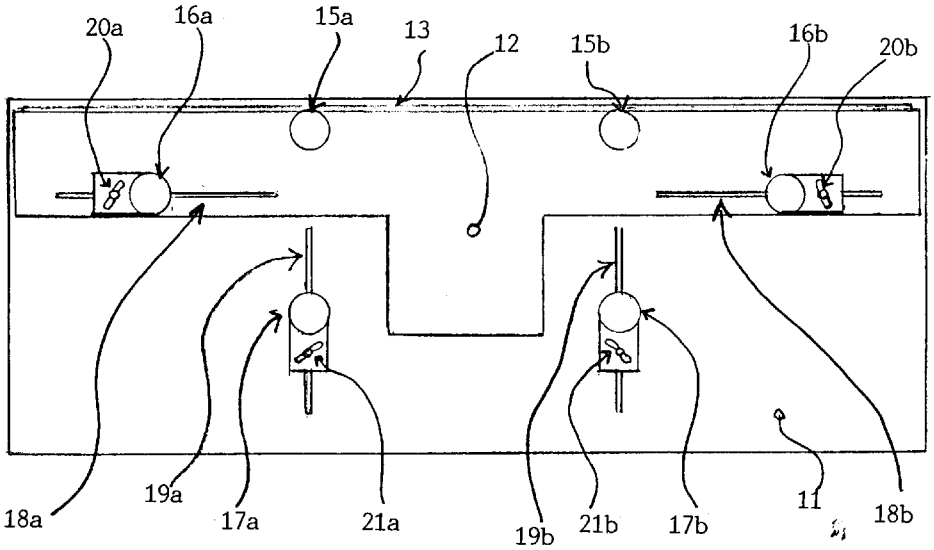
FIG. 2 is an overhead view of the holding device unoccupied by a musical instrument.

FIG. 2 shows the arrangement of the rearward vertical extensions 15*a* & 15*b* which along with the adjustable side vertical extensions 16*a* & 16*b* are attached to the hinged moveable horizontal surface 12 and are positioned to provide rearward and lateral restraint. The adjustable forward vertical extensions 17*a* & 17*b* are attached to the stationary horizontal base 11 and will provide restraint against forward movement of the instrument 10 when it is placed in the holding device and forward movement is affected by rotation of the moveable assembly comprised of the hinged moveable horizontal surface 12, rearward vertical extensions 15*a* & 15*b*, and side vertical extensions 16*a* & 16*b* on the axis created by hinge 13. Adjustment of the side vertical extensions is accomplished by sliding the adjustable side vertical extensions 16*a* & 16*b* to the appropriate positions in slots 18*a* & 18*b,* and then tightening the wing-nut/screws 20*a* & 20*b*. In a similar fashion, the adjustment of the adjustable forward vertical extensions is accomplished by sliding the adjustable forward vertical extensions 17*a* & 17*b* to the appropriate positions in slots 19*a* & 19*b,* and then tightening wing-nut/screws 21*a* & 21*b*. The positions of rearward vertical extensions 15*a* & 15*b* are fixed and universally appropriate for all types and sizes of musical instruments in consideration for use with the present invention.

Figure 3:
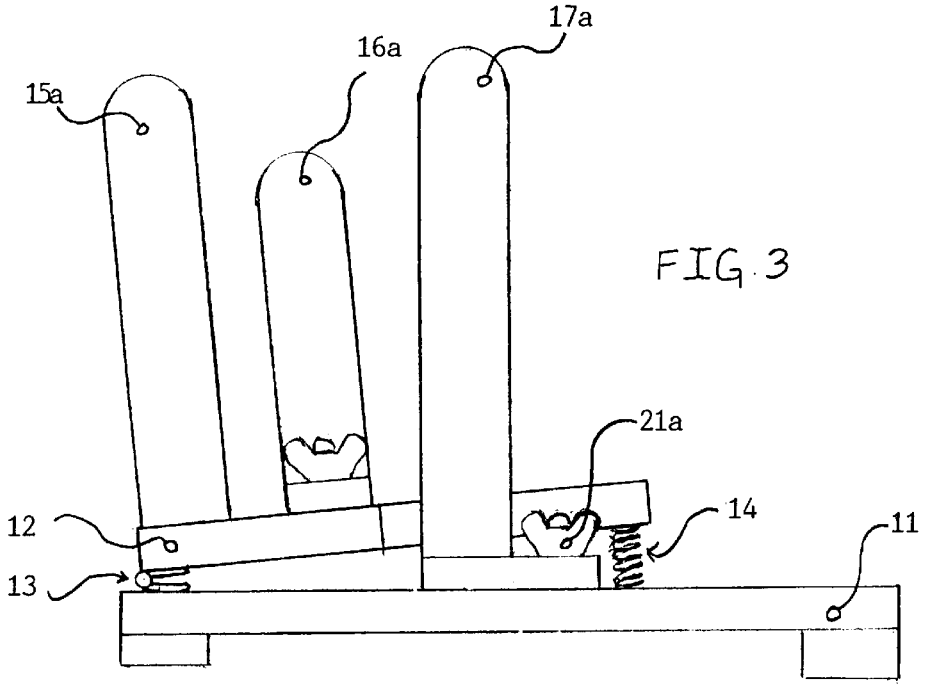
FIG. 3 is a side elevation of the holding device with a typical musical instrument shown by phantom lines.

FIG. 3 shows the moveable assembly comprised of the hinged horizontal surface 12, rearward vertical extension 15*a,* and side vertical extension 16*a* in a rearward orientation posterior to the axis of the hinge 13 caused by the upward force of the spring 14 pressing against the hinged moveable horizontal surface 12 deflecting off the stationary horizontal base 11. Also shown is the forward stationary vertical extension 17*a* held in an appropriate preadjusted position by the wing-nut/screw 21*a*.

Figure 4:
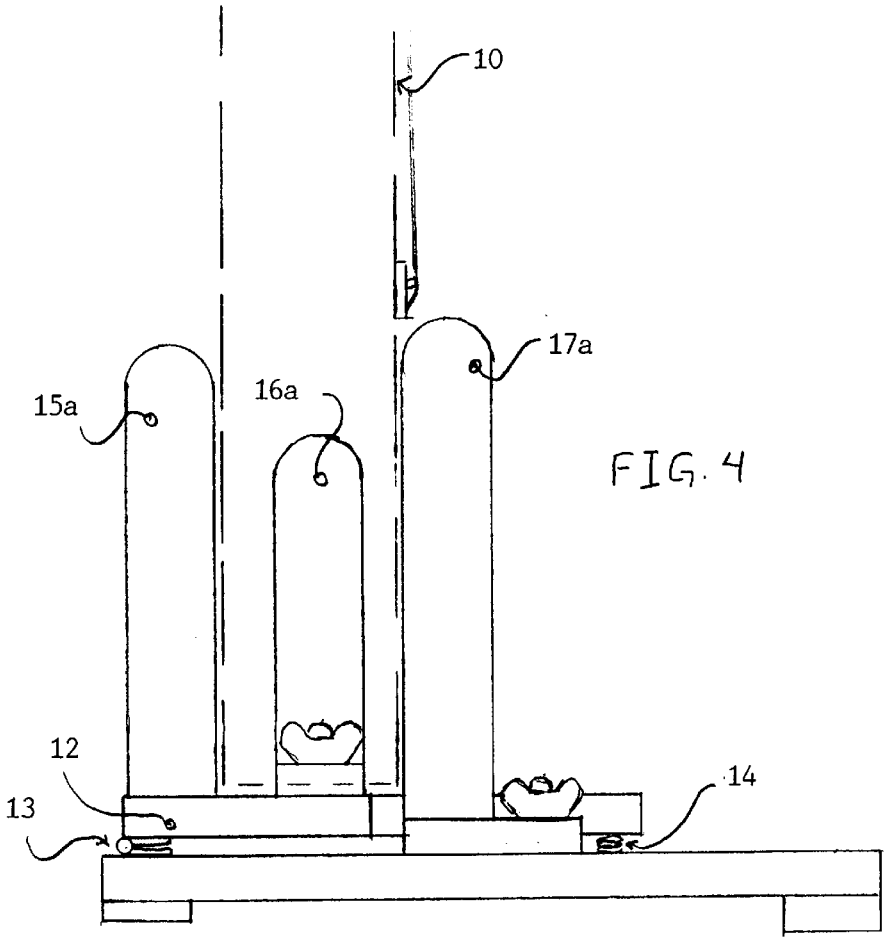
FIG. 4 is a side elevation of the unoccupied holding device.

FIG. 4 gives the same view as FIG. 3 with the exception that a musical instrument 10 is being held by the device. This figure shows that the weight of the musical instrument 10 has compressed spring 14 and returned the moveable horizontal surface 12 to a 0 degree orientation to the axis of the hinge 13, causing the attached rearward vertical extension 15*a* and the side vertical extension 16*a* forcing the musical instrument 10 against the stationary forward vertical extension 17*a* effecting the holding action of the present invention.

What is claimed is:

1. A device for holding a longitudinally elongate musical instrument in an upright position, said device comprising:

a flat stationary horizontal base to which is attached via a laterally axial hinge, a moveable horizontal surface from which projects one or more rearward vertical extensions which are reasonably offset from the lateral center of said device, whereby when the force supplied by the weight of said musical instrument is applied to said hinged moveable horizontal surface, such force is converted via the fulcrate action of said hinge to a forward motion and force of said rearward vertical extensions against one or more forward vertical extensions which are attached to said stationary horizontal base, thereby restraining imbalance of said musical instrument from its longitudinally upright orientation; and one or more laterally opposed side vertical extensions attached to said hinged moveable horizontal surface which cooperatively maintain the longitudinally upright orientation of said musical instrument.

2. The device of claim 1 wherein said one or more side vertical extensions are adjustable and fixable in their relative distance from said one or more rearward vertical extensions.

3. The device of claim 1 wherein said laterally opposed side vertical extensions are adjustable and fixable in the relative distance from the lateral center of said device and from each other.

4. The device of claim 1 wherein said moveable horizontal surface with said attached rearward vertical extensions and said attached side vertical extension is held in a slightly rearward angle of orientation about said axis of said hinge when said device is unoccupied by said musical instrument by a spring attached to either or both the bottom of said moveable horizontal surface and/or the top of said stationary horizontal base.

* * * * *